US007255397B2

(12) United States Patent
Olcheski

(10) Patent No.: US 7,255,397 B2
(45) Date of Patent: Aug. 14, 2007

(54) INFRARED SENSING LIFT CHAIR

(75) Inventor: James Olcheski, Pittston Township, PA (US)

(73) Assignee: Golden Technologies, Inc., Old Forge, PA (US)

( * ) Notice: Subject to any disclaimer, the term of this patent is extended or adjusted under 35 U.S.C. 154(b) by 534 days.

(21) Appl. No.: 10/925,401

(22) Filed: Aug. 25, 2004

(65) Prior Publication Data

US 2006/0103209 A1 May 18, 2006

(51) Int. Cl.
*A47C 1/024* (2006.01)

(52) U.S. Cl. ..... 297/330; 297/217.3; 297/344.17; 297/DIG. 10

(58) Field of Classification Search ..... 297/217.3, 297/330, 325–328, 344.17, DIG. 10; 248/157, 248/161, 404, 421; 340/501, 540, 584
See application file for complete search history.

(56) References Cited

U.S. PATENT DOCUMENTS

| | | | | |
|---|---|---|---|---|
| 4,407,030 | A | 10/1983 | Elliott | |
| 4,552,403 | A | 11/1985 | Yindra | |
| 5,040,832 | A | 8/1991 | Zalewski | |
| 5,165,753 | A | 11/1992 | Henderson | |
| 5,265,935 | A | 11/1993 | Geisler et al. | |
| 5,594,238 | A | 1/1997 | Endruschat et al. | |
| 5,628,546 | A | 5/1997 | Boetzkes | |
| 5,803,491 | A | 9/1998 | Barnes et al. | |
| 5,871,232 | A * | 2/1999 | White | 280/735 |
| 5,890,869 | A | 4/1999 | LeMaster et al. | |
| 5,895,093 | A | 4/1999 | Casey et al. | |
| 5,931,532 | A | 8/1999 | Kemmerer et al. | |
| 5,984,411 | A | 11/1999 | Galumbeck | |
| 6,091,322 | A | 7/2000 | Ang et al. | |
| 6,106,062 | A | 8/2000 | Ambrose, Jr. et al. | |
| 6,338,531 | B1 | 1/2002 | Hausherr et al. | |
| 6,492,786 | B1 | 12/2002 | Vang et al. | |
| 6,578,917 | B1 | 6/2003 | Aubert et al. | |
| 6,644,745 | B2 | 11/2003 | Rogers et al. | |
| 6,652,033 | B2 | 11/2003 | Satoh | |
| 6,659,556 | B2 | 12/2003 | Pellerin | |
| 6,929,323 | B2 * | 8/2005 | Enno | 297/217.3 |
| 6,981,745 | B2 * | 1/2006 | Rees | 297/330 |

* cited by examiner

*Primary Examiner*—Peter R. Brown
(74) *Attorney, Agent, or Firm*—Volpe and Koenig, P.C.

(57) ABSTRACT

The present invention provides an adjustable furnishing such as a lift chair including a support member with a surface for supporting a user. A mechanism is connected to the support member for adjusting a position of the support member. One or more infrared radiation sensors are positioned beneath the surface of the support member to generate a signal when a heated body is detected in proximity to the mechanism. A controller is provided for receiving the signal from the infrared radiation sensors and inhibiting travel of the mechanism and the support member in a direction of the detected heated body.

34 Claims, 4 Drawing Sheets

INFRARED SENSING LIFT CHAIR

BACKGROUND

Power operated lift chairs are useful for raising persons, especially those having impaired mobility, from a seated to a standing position. These chairs include a powered lift mechanism which raises and tilts the chair allowing a seated occupant to stand with a limited amount of exertion. Further, in a reverse mode, the seat may lower a user from a standing to a seated position. U.S. Pat. Nos. 4,007,960, 4,083,599, and 4,993,777 describe various known lift chairs.

Lift chairs of the type known in the art typically include a base frame which rests on the floor, a mechanism attached to the base frame, an electric motor-driven actuator for motivating the mechanism, and a seating portion for receiving a user. When the lift chair is raised, a gap is formed between the seating portion and the base frame. This gap poses a risk to a pet, a small child, or an unwary adult that may wander between the seating portion and the base frame. Injury may be caused when the lift chair is adjusted from a raised to a lowered position causing the person or pet to be compressed between chair components.

It is known to use ribbon sensing switches under a seating portion or on a base frame of a lift chair, whereby a foreign object under the seating portion may contact one of the sensing switches cutting power off to a mechanism actuator. This configuration may not provide an adequate solution to the problem of protecting humans or animals that move into a position beneath a lift chair. It is possible for a human or animal to avoid contact with the sensing switches and become injured by the moving mechanism, because it is impractical to provide such a ribbon sensing switch on every potentially dangerous portion of the lift chair. Further, since many types of sensing switches require contact with an object before motion of the mechanism can be stopped, a living being may become injured trying to escape the moving lift chair or become trapped after the motion of the mechanism is stopped.

It has also been suggested that light sensors be used to sense a foreign object under a lift chair. However, this solution fails to address some of the problems in a practical and effective manner. Light sensors require a light transmitter and a light receiver which detects changes in the transmitted light. Since the size and shape of an area under a seating portion of a lift chair changes significantly during a raising or lowering operation, a sophisticated and expensive controller may be required to prevent false detection of a foreign object. Moreover, the quantity of receivers and/or transmitters that are potentially required to cover an entire area under the seating portion of a lift chair is impractical and cost prohibitive.

It would be desirable to provide an effective, practical and cost effective system which prevents injury of a living being which enters beneath a seating portion of a lift chair.

SUMMARY

The present invention provides an adjustable furnishing, such as a lift chair, including a support member with a surface for supporting a user. The support member may include a seat portion of a lift chair. A mechanism is connected to the support member for adjusting a position of the support member. One or more infrared radiation sensors are positioned beneath the surface of the support member to generate a signal when a heated body is detected in proximity to the mechanism. A controller is provided for receiving the signal from the infrared radiation sensors and providing a warning and/or inhibiting travel of the mechanism and the support member in a direction of the detected heated body.

BRIEF DESCRIPTION OF THE DRAWING(S)

DETAILED DESCRIPTION OF THE PREFERRED EMBODIMENT(S)

Figure 1:
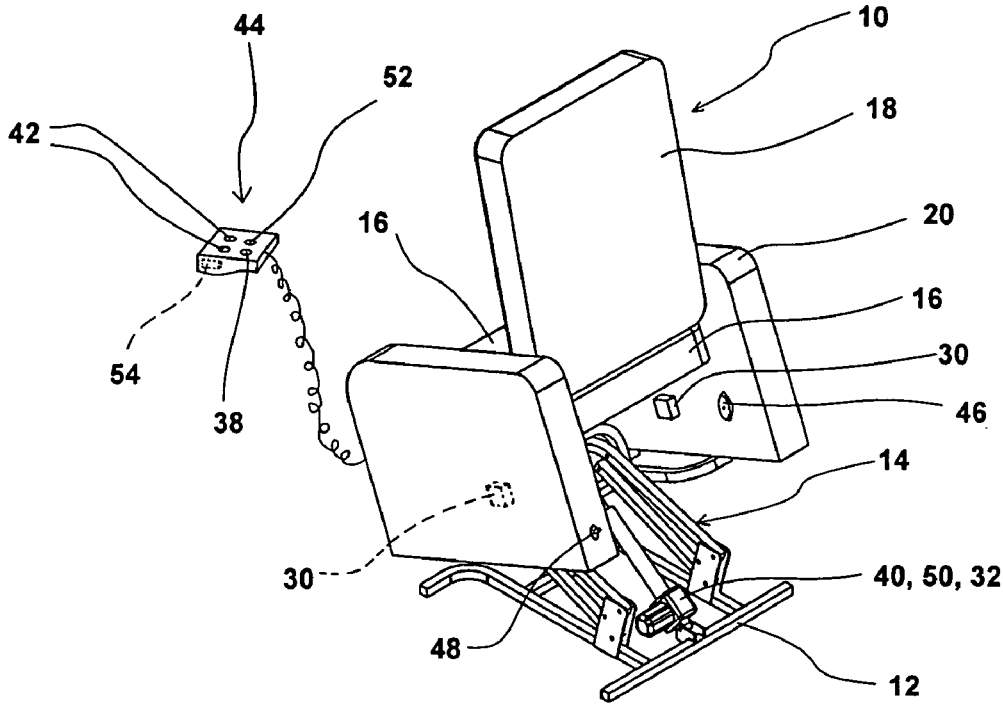
FIG. 1 is a rear perspective view of a lift chair according to a preferred embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention are described below with reference to the drawing figures where like numerals represent like elements throughout.

Referring to FIG. 1, an adjustable furnishing in the form of a lift chair 10 is shown. The lift chair 10 includes a base 12 which supports a plurality of linkages of a mechanism 14. Alternatively, the base 12 may be omitted, and the mechanism 14 may be mechanically fastened to a pre-existing structure. User support members are provided including a seat portion 16, a back rest portion 18, and preferably armrests 20 which are connected to the mechanism 14. The mechanism 14 is configured to adjust the support members from a lowered position, where the seat portion 16 is substantially horizontal relative to a surface on which the base 12 rests, to a raised position (as shown in FIG. 1), where the seat portion is elevated and angled.

An actuator 40 is provided which adjusts the mechanism 14 according to signals or power provided by a controller 32, which preferably receives signals from a user through switches 42 positioned on a remote control 44. The remote control 44 can be wired to the controller 32, or can be wireless. The controller 32 may be positioned in proximity to the actuator 40 as shown, or alternatively, may be located within the remote control 44 or at any other suitable location on the lift chair 10 or external to the lift chair 10. The actuator 40 is preferably an electric motor-driven linear screw-type actuator. However, any suitable actuator may be used.

Infrared radiation sensors 30 are positioned beneath the seat portion 16 for generating a signal in response to radiant heat detected from a heated body in a given area in proximity to the mechanism 14 and the base 12. The sensors 30 are preferably arranged to detect a heated body anywhere in proximity to a perimeter of the lift chair, or in an area bounded by the lift chair perimeter, such that a heated body passing under the chair from any side will be detected. As shown, the sensors 30 are positioned on the inside of armrests 20. Alternatively, the sensors 30 could be positioned in any suitable location which would allow detection of a heated body in proximity to the mechanism 14 and the base 12. Sensors may even be positioned exposed on an external surface of the lift chair to detect heated bodies near the lift chair but not under the support members 16, 18, 20. While two sensors 30 are pictured in FIG. 1, any number of sensors may be provided as required to detect a heated body in the given area.

Each of the sensors 30 may optionally be provided with a lens, such as a Fresnel lens, for focusing radiation emanating from a desired area into the sensor 30. Further, the sensors 30 are preferably provided with a filter for limiting radiation incident on the sensor to wavelengths between approximately 8 and 15 microns, the range associated with radiation emitted by a human body. Optionally, a heat shield 50 is provided to cover the drive for the actuator 40 to prevent the sensors 30 from detecting heat generated by the electric motor or other components of the actuator 40. Alternatively, the heat shield 50 may be omitted depending on positioning and sensitivity of the sensors. Preferably, the infrared sensors are pyroelectric (PIR) sensors which are capable of detecting small changes in infrared energy. Sensors of this type are manufactured by Nippon Ceramic Co., Ltd. Japan. Alternatively, other types of infrared sensors may be used.

The controller 32 receives a signal from one or more of the infrared radiation sensors 30 when a heated body is detected. Upon receiving a signal, the controller 32 can shut off power to the actuator 40, preventing motion of the mechanism 14 and support members 16, 18, 20. Alternatively, after receiving a signal from the sensor, the controller 32 can reverse a direction of motion of the actuator to maneuver the mechanism 14 away from a detected heated body.

The controller 32 may be configured to disable the sensors 30 during certain predetermined lift chair operations or permit certain actuation operations regardless of whether a heated body is detected by the sensors 30. For example, during a chair raising operation where risk of injury to a detected body is low, the controller may signal the actuator to raise the chair despite having received a signal from the sensors 30 indicative of a heated body. Otherwise, the controller 32 may simply disable the sensors 30 when the actuator is raising the chair. The controller 32 can determine whether the actuator is raising the chair by, for example, monitoring the polarity of voltage sent to the actuator.

Preferably, a reset switch 38 is provided. If the controller 32 cuts off power to the actuator 40, or prevents motion of the actuator 40 in a given direction, manually pressing the reset switch 38 signals the controller 32 to resume normal operation. The reset switch 38 is preferably located on the remote control 44. A chair-mounted reset switch 48 may be provided in addition to or instead of the reset switch 38 located on the remote control.

In addition to or instead of inhibiting motion of the mechanism 14, the controller 32 may activate an alarm to alert a user that a heated body has been detected. The alarm may be an audible alarm such as piezo buzzer 46, or a visible alarm, such as an LED indicator light 52. Also, a vibrator 54 incorporated into the remote control 44, or any other suitable warning device, may serve as an alarm. Further, any combination of audible, visible, vibrating, or other alarms may be utilized.

Figure 2:
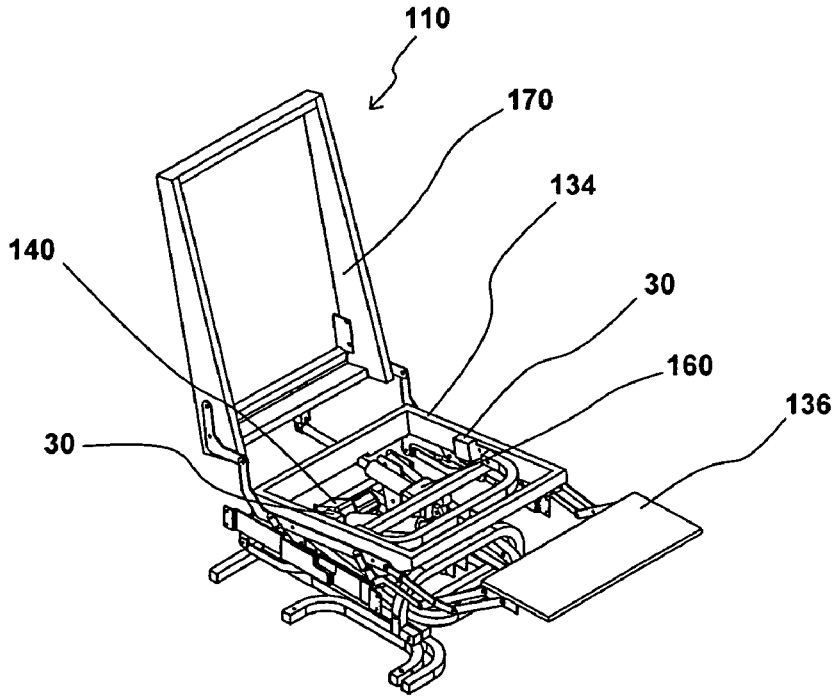
FIG. 2 is a front perspective view of a reclining lift chair according to another preferred embodiment of the present invention.

Referring to FIG. 2, an alternative preferred embodiment of the present invention is shown. A reclining lift chair 110 having a foot rest 136 and a seat portion frame 134 is shown without cushions or upholstery in a lowered position. Infrared sensors 30 are provided on the seat portion frame 134. A first actuator 140 for raising the seat portion frame 134 and a second actuator 160 to control a back rest portion frame 170 are provided. Using the actuators 140, 160, a controller can coordinate motion of the seat portion frame 134 and the back rest portion frame 170 to assist a user in attaining a seated or standing position. Alternatively, one or more additional actuators may be provided to allow additional range(s) of motion. Also, each actuator 140, 160 may be provided with a heat shield on its drive to prevent the sensors 30 from sensing heat from the actuator.

Figure 3:
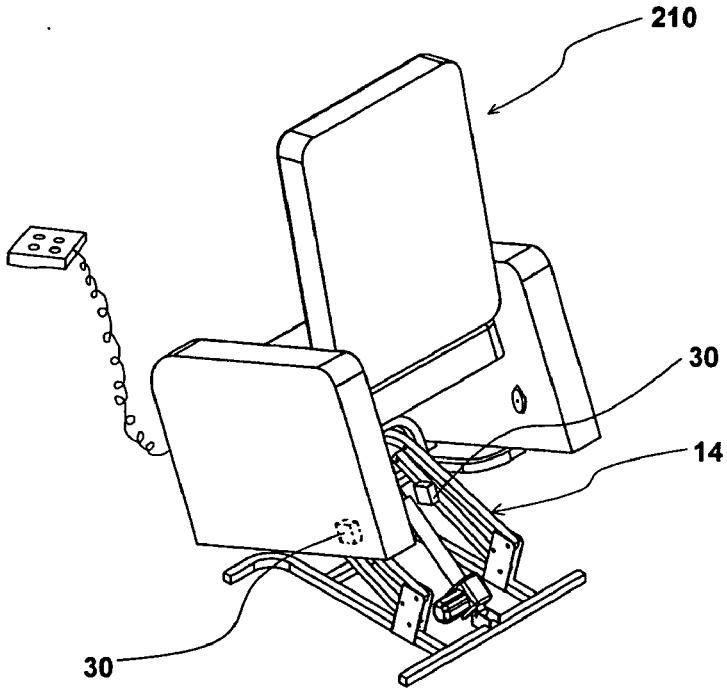
FIG. 3 is a rear perspective view of a lift chair according to yet another preferred embodiment of the present invention.

Referring to FIG. 3, another alternative preferred embodiment of the present invention is shown. A lift chair 210, structurally similar to the lift chair 10 of FIG. 1 is shown. The lift chair 210 includes infrared sensors 30 positioned on a linkage of the mechanism 14. Such a configuration may be advantageous if obstructions are present which prevent a sensor located elsewhere on the lift chair from sensing a nearby heated body.

Figure 4:
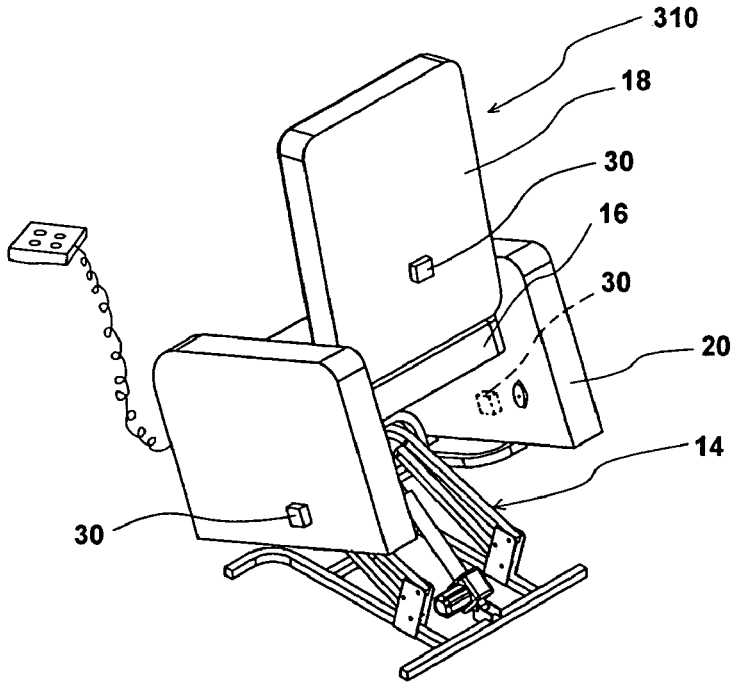
FIG. 4 is a rear perspective view of a lift chair according to another preferred embodiment of the present invention.

In a separate alternative preferred embodiment, FIG. 4 shows a lift chair 310, also structurally similar to the lift chair 10. However, the lift chair 310 includes the sensors 30 positioned on external surfaces of support members 16, 18, 20 to detect heated bodies near the lift chair 310, at backs and side portions of the lift chair 310 outside the perimeter of the lift chair's base.

Figure 5:
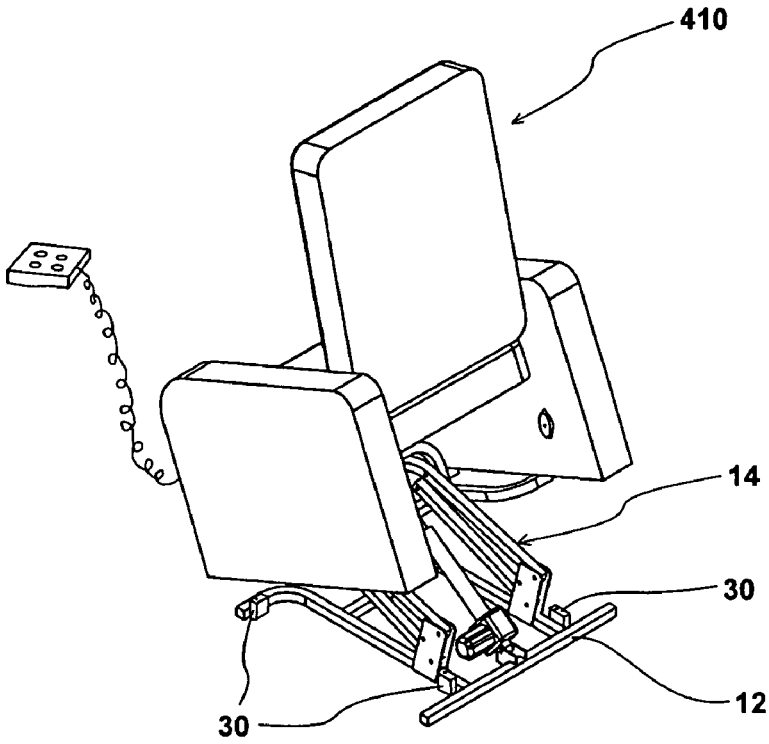
FIG. 5 is a rear perspective view of a lift chair according to another preferred embodiment of the present invention.

FIG. 5 shows another alternative preferred embodiment of a lift chair 410. The lift chair 410 includes infrared sensors 30 which are mounted to separate locations on the base 12. In the preferred embodiments shown in FIGS. 1-5, the sensors 30 are positioned to detect a heated body anywhere in proximity to a perimeter of the lift chair, or an area bounded by the lift chair perimeter, such that a heated body passing under the chair will be detected. Further, the number of sensors required to detect a heated body is not limited to the number of sensors 30 pictured in the described embodiments, and may depend on the type of sensor and size of an area in which sensing is required. However, a minimum of two sensors 30 is preferred.

Figure 6:
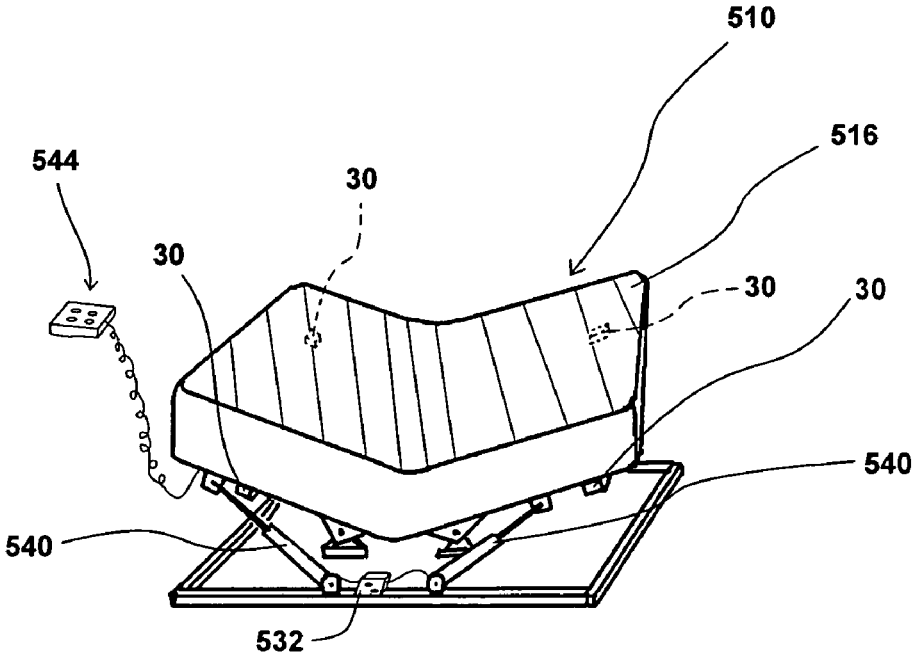
FIG. 6 is a perspective view of an adjustable bed according to another preferred embodiment of the present invention.

One skilled in the art will recognize that the present invention is not limited to lift chairs. Many types of adjustable furnishings can benefit from the use of infrared sensors. FIG. 6 shows an adjustable bed 510 according to an alternative preferred embodiment including a mattress support 516, actuators 540, a controller 532, and a remote control 544. The adjustable bed 510 includes sensors 30 under the mattress support 516 to detect a heated body in proximity to a perimeter of the adjustable bed 510, or an area bounded by the adjustable bed's perimeter, such that a heated body passing under the bed 510 from any side will be detected. If a heated body is detected, the sensors 30 signal the controller 532 to shut off power to the actuators 540 and/or signals a user in the manner described above with reference to the lift chair of FIG. 1.

Figure 7:
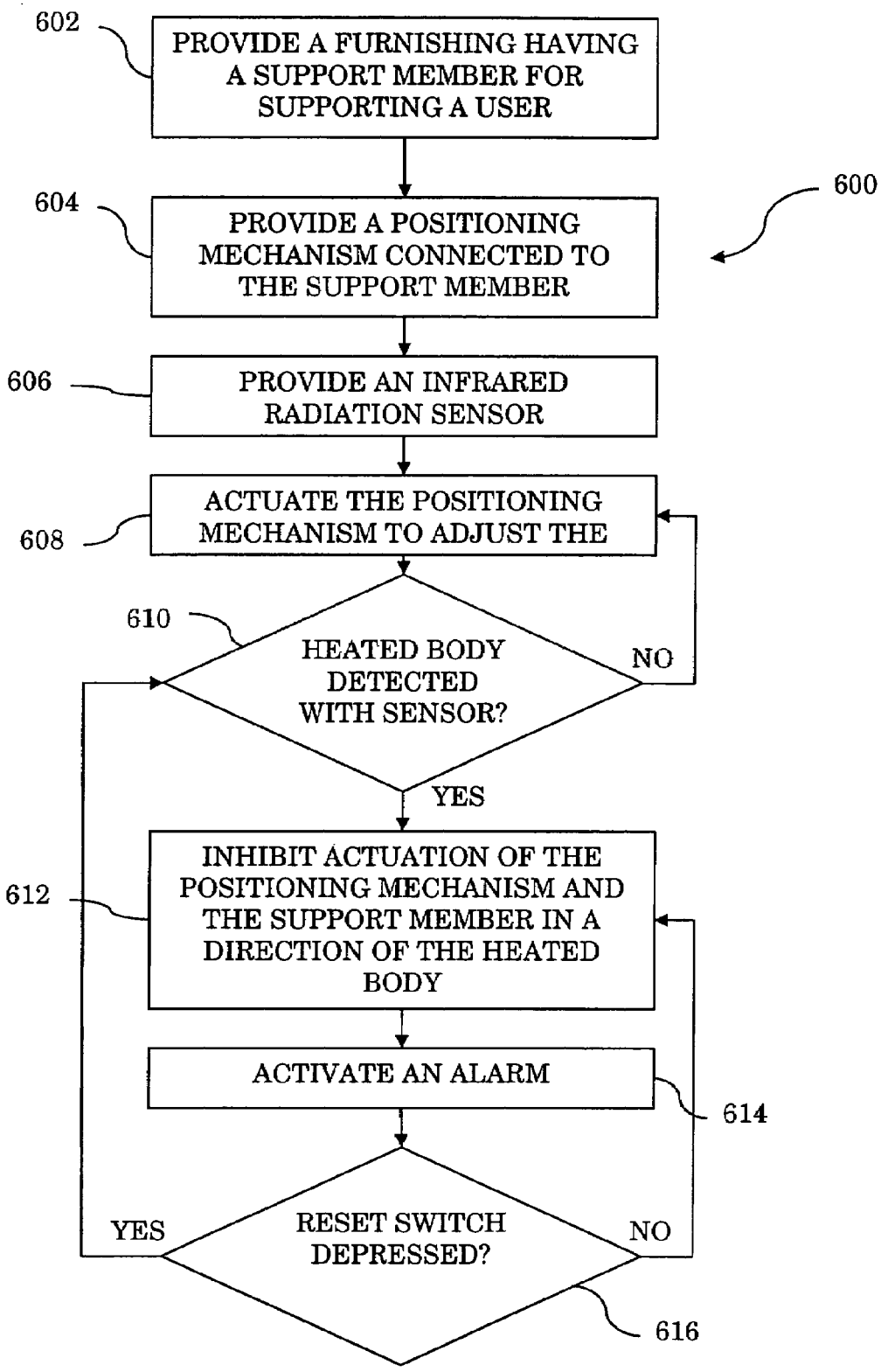
FIG. 7 is a flowchart depicting a method for adjusting a furnishing according to a preferred embodiment of the present invention.

Referring to FIG. 7, a flow chart 600 for a method is provided for adjusting a furnishing according to a preferred embodiment of the present invention. In a step 602, a furnishing having a support member for supporting a user is provided. The furnishing may be one of the types described above with reference to FIGS. 1-6, or another type of furnishing. In a step 604, a mechanism is provided connected to the support member. An infrared sensor is provided in a step 606 for detecting a heated body in proximity to the mechanism and support member in a space beneath the support member. In a step 608, the mechanism is actuated. The mechanism may be actuated using manual controls. In a step 610, it is determined whether a heated body is detected. Preferably, only heated bodies which emit radiation having wavelengths between 8 and 15 microns (wavelengths typically indicative of a living being) are detected by the sensor. If detection of a heated body occurs, continued motion of the mechanism is inhibited (step 612) at least in a direction of the heated body. Motion may be inhibited by preventing actuation of the mechanism or reversing a direction of actuation such that the mechanism and support member are moved away from the detected heated body. In addition to or in place of step 612, an audible, visible, or vibratory alarm is triggered, as shown in step 614, to inform the user of the detected heated body. Preferably, in a step 616, it is determined whether a reset switch has been pressed. If the reset switch has been pressed, there is a return to step 610 to again determine whether a heated body is detected. Otherwise, if it is determined that the reset switch has not been pressed, there is a return to step 612 to continue inhibiting actuation of the mechanism and support member. Alternatively, if a reset switch is not provided, after a predetermined length of time after commencement of steps 612 and 614, there is a return to a step 610 to again determine whether a heated body is detected. If no heated body is detected in step 610, actuation of the mechanism is continued in a return to step 608.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. Adjustable furnishing comprising:

at least one support member including a surface for supporting a user;

at least one mechanism connected to the support member for adjusting a position of the support member;

at least one infrared radiation sensor positioned beneath the surface which generates a signal upon detecting a heated body in proximity to the at least one mechanism; and a controller for receiving the signal from the at least one infrared radiation sensor and at least one of signaling the user and inhibiting travel of the mechanism and the support member in a direction of the detected heated body in response to the signal.

2. The adjustable furnishing according to claim 1, further comprising a base connected to the at least one mechanism to support the furnishing.

3. The adjustable furnishing according to claim 1, further comprising at least one lens for focusing radiation into the radiation sensor.

4. The adjustable furnishing according to claim 1, further comprising at least one filter for limiting radiation incident on the radiation sensor.

5. The adjustable furnishing according to claim 1, further comprising at least one filter for limiting radiation incident on the sensor to wavelengths between approximately 8 and 15 microns.

6. The adjustable furnishing according to claim 1, further comprising an actuator for adjusting the mechanism, and the controller is connected to the actuator for preventing the actuator from adjusting the mechanism when the infrared radiation sensor detects a heated body.

7. The adjustable furnishing according to claim 1, further comprising an actuator for adjusting the mechanism, and the controller is connected to the actuator for reversing a direction of motion of the actuator when the infrared radiation sensor detects a heated body.

8. The adjustable furnishing according to claim 1, further comprising an actuator for adjusting the mechanism, and the controller is connected to the actuator for turning off power to the actuator when the infrared radiation sensor detects a heated body.

9. The adjustable furnishing according to claim 1, further comprising an actuator for adjusting the mechanism, and the controller is connected to the actuator for preventing motion of the actuator in a first direction when the infrared radiation sensor detects a heated body and allowing motion of the actuator in a second direction opposite the first direction when the infrared sensor detects a heated body.

10. The adjustable furnishing according to claim 1, further comprising an alarm, and the controller is connected to the alarm for activating the alarm when the infrared radiation sensor detects a heated body.

11. The adjustable furnishing according to claim 10, wherein the alarm includes at least one of an audible device, a visible device and a vibratory device.

12. The adjustable furnishing of claim 10, further comprising a remote control for adjusting the mechanism, wherein the alarm includes an indicator light on the remote control.

13. The adjustable furnishing of claim 10, further comprising a remote control for adjusting the mechanism, wherein the alarm includes a vibrator in the remote control.

14. The adjustable furnishing according to claim 1, further comprising:

an actuator including an electric motor; and a heat shield located between the electric motor and the at least one radiation sensor for preventing radiation emitted by the electric motor from being received by the sensor.

15. The adjustable furnishing according to claim 1, wherein the at least one support member comprises a seat portion and a back rest portion of a chair.

16. The adjustable furnishing according to claim 1, wherein the at least one support member comprises a mattress support of a bed.

17. The adjustable furnishing according to claim 1, wherein the at least one infrared radiation sensor is positioned to receive infrared signals from a heated body disposed between the at least one support member and a space under the adjustable furnishing.

18. The adjustable furnishing according to claim 1, wherein the at least one infrared radiation sensor comprises a plurality of infrared radiation sensors for detecting a heated body in proximity to a perimeter of the adjustable furnishing between the support member and a floor that supports the adjustable furnishing.

19. The adjustable furnishing according to claim 1, wherein the at least one infrared radiation sensor is attached to the at least one support member.

20. The adjustable furnishing according to claim 1, wherein the at least one infrared radiation sensor is attached to the at least one mechanism.

21. The adjustable furnishing according to claim 1, further comprising a base connected to the at least one mechanism to support the furnishing, and the at least one infrared radiation sensor is connected to the base.

22. The adjustable furnishing according to claim 1, wherein the at least one infrared radiation sensor is a pyroelectric sensor.

23. The adjustable furnishing according to claim 1, further comprising a reset switch connected to the controller, wherein after receiving a signal from the sensor indicating detection of a heated body, the controller is configured to inhibit the travel of the mechanism until receiving a signal from the reset switch.

24. A method for adjusting a furnishing, the furnishing having at least one support member for supporting a user, the method comprising:

providing a positioning mechanism connected to the support member;

providing an infrared radiation sensor in proximity to the positioning mechanism;

actuating the positioning mechanism to adjust the furnishing;

detecting a heated body in proximity to the positioning mechanism and support member in a space beneath the support member using the infrared radiation sensor to detect infrared radiation emitted by a heated body; and at least one of signaling the user and inhibiting travel of the mechanism and the support member in a direction of the detected heated body.

25. The method of claim 24, further comprising preventing motion of the mechanism when a heated body is detected.

26. The method of claim 24, further comprising actuating an alarm when a heated body is detected.

27. The method of claim 24, wherein the detecting of a heated body includes detecting only infrared radiation having wavelengths between approximately 8 and 15 microns.

28. The method of claim 24, further comprising activating a reset switch to re-detect a heated body, and to continue actuating the mechanism if a heated body is not detected.

29. The method of claim 24, wherein the detecting of a heated body only occurs when the mechanism is being actuated to move the support member toward a surface on which the furnishing rests.

30. A lift chair comprising:

at least one support member including a surface for supporting a user;

at least one mechanism connected to the support member for adjusting a position of the support member;

at least one infrared radiation sensor, positioned to detect a heated body in proximity to at least a portion of a perimeter of the lift chair, which generates a signal upon detecting a heated body; and a controller for receiving the signal from the at least one infrared radiation sensor and inhibiting travel of the mechanism and the support member in a direction of the detected heated body in response to the signal.

31. A lift chair comprising:

at least one support member including a surface for supporting a user;

at least one mechanism connected to the support member for adjusting a position of the support member;

at least one infrared radiation sensor, positioned to detect a heated body in proximity to at least a portion of a perimeter of the lift chair, which generates a signal upon detecting a heated body;

a controller for receiving the signal from the at least one infrared radiation sensor; and an alarm connected to the controller for being activated by the controller when the infrared radiation sensor detects a heated body.

32. The lift chair of claim 31, wherein the alarm is an audible device.

33. The lift chair of claim 31, wherein the alarm is a visible device.

34. The lift chair of claim 31, wherein the alarm is a vibratory device.

* * * * *